US006016781A

United States Patent [19]

Toyama

[11] Patent Number: 6,016,781

[45] Date of Patent: Jan. 25, 2000

[54] PRESSURE-DETECTING DEVICE FOR INTERNAL COMBUSTION ENGINE

[75] Inventor: Takeshi Toyama, Shizuoka-ken, Japan

[73] Assignee: Suzuki Motor Corporation, Shizuoka-ken, Japan

[21] Appl. No.: 09/061,412

[22] Filed: Apr. 16, 1998

[30] Foreign Application Priority Data

Apr. 30, 1997 [JP] Japan ..... 9-126476

[51] Int. Cl.[7] ..... F02B 77/08

[52] U.S. Cl. ..... 123/184.42

[58] Field of Search ..... 123/184.21–184.61, 123/480, 481, 568.21

[56] References Cited

U.S. PATENT DOCUMENTS 5,054,460 10/1991 Ogita ..... 123/568.21
5,481,461 1/1996 Miyamoto et al. ..... 123/481
5,778,856 7/1998 Okada et al. ..... 123/480

FOREIGN PATENT DOCUMENTS 3-121216 5/1991 Japan .
7-31094 4/1995 Japan .

*Primary Examiner*—Marguerite McMahon
*Attorney, Agent, or Firm*—Flynn, Thiel, Boutell & Tanis, P.C.

[57] ABSTRACT

A pressure-detecting device for an internal combustion engine, in which piping and the like need not be provided, thereby eliminating clogging of such piping by foreign matter or due to freezing thereof. The pressure-detecting device includes a pressure sensor for detecting intake pipe pressure inside the intake manifold, which pressure sensor is mounted on the top of the surge tank of the intake manifold.

8 Claims, 4 Drawing Sheets

PRESSURE-DETECTING DEVICE FOR INTERNAL COMBUSTION ENGINE

FIELD OF THE INVENTION

This invention relates to a pressure-detecting device for an internal combustion engine and, more particularly, to a pressure-detecting device for an internal combustion engine in which piping and the like for use on a pressure sensor is eliminated.

BACKGROUND OF THE INVENTION

In internal combustion engines for vehicles, a pressure sensor is provided in order to detect intake pipe pressure which serves as one indicator of how the engine is running.

More specifically, FIG. 4 shows a conventional internal combustion engine 108 disposed in an engine room 106 within a hood outline 104 of a vehicle 102. The engine 108 is provided with an intake manifold 112. The manifold 112 is equipped with a surge tank 110. A pressure sensor 120 is mounted on a vehicle-side panel 116 toward a dash panel 114 by means of a bracket 118. The pressure sensor 120 is connected to one end of a pressure introduction hose 122. The other end of the hose 122 is linked to a nipple 124. The nipple 124 is mounted on the surge tank 110 so that the intake pipe pressure of the tank 110 can be taken. Since vibrations on the side of the engine 108 differ from that on the vehicle body side, then respective portions of the pressure introduction hose 122, i.e. where the hose 122 is connected to the nipple 124 and pressure sensor 120, are loosened in order to prevent the hose 122 from being accidentally disconnected from the nipple 124 and/or the pressure sensor 120. In addition, the hose 122 is fitted with a clip (not shown) at an introduction portion of the hose 122 to this same end. Further, the routing of the hose 122 makes it difficult to position the nipple 124 at a distance greatly spaced away from the pressure sensor 120. To this end, components such as pipes are disposed between the nipple 124 and the pressure sensor 120.

Such examples of a pressure-detecting device for an internal combustion engine are disclosed in published Japanese Patent Applications No. 7-31094 and No. 3-121216. According to the former publication, the capacity of a piping system and/or a piping length are selected so as to be less than predetermined values, thereby preventing intrusion of liquid. According to the latter publication, an air reserve chamber is provided in the surge tank, and is connected to a pressure introduction hose.

In the conventional pressure-detecting devices, components such as the pressure introduction hose or pipe are used as cable routing. The hose, in this case, includes a passage therein having a small inner diameter. This causes an inconvenience in that: such a passage is liable to be clogged, either by foreign matter or by freezing; and, in particular, moisture readily resides in the pressure introduction hose at loose portions thereof, with a consequential increase in the likelihood of the hose freezing up at such loose portions.

Another inconvenience with the conventional devices is that such a structure makes it difficult to place the pressure sensor at the proper position for proper or optimum detection.

SUMMARY OF THE INVENTION

In order to obviate or minimize the above-described inconveniences, the present invention provides a pressure-detecting device for an internal combustion engine, including a pressure senor for detecting intake pipe pressure inside an intake manifold having a surge tank, whereby the pressure sensor is disposed on the top of the surge tank.

Pursuant to the present invention, the pressure sensor is mounted directly on the top of the surge tank without the need for piping and the like. This eliminates clogging of such piping and the like by foreign matter or clogging due to freezing of the pipe. Further, the pressure sensor can be provided at any position to ensure proper detection of the intake pipe pressure.

DETAILED DESCRIPTION

Figure 1:
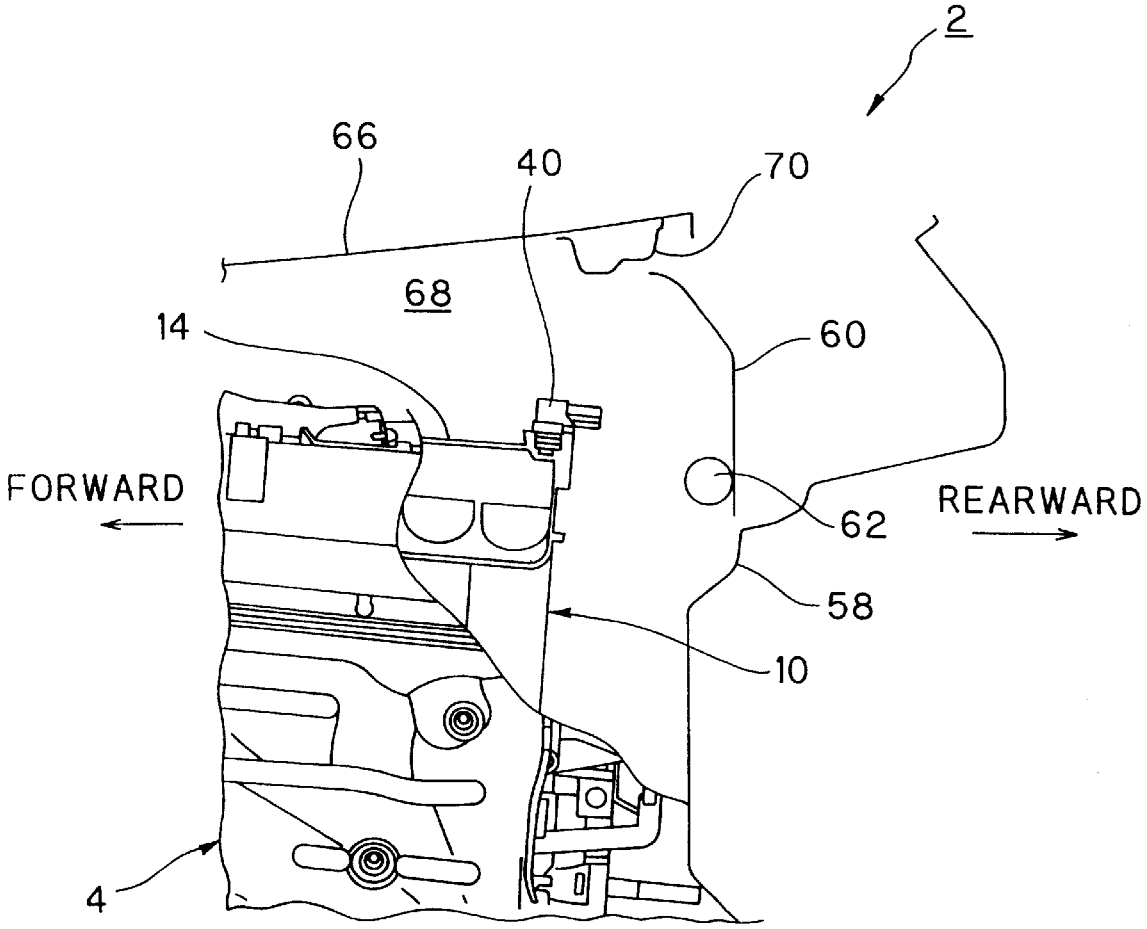
FIG. 1 is a fragmentary side view of an engine illustrating a pressure-detecting device according to the present invention.

An embodiment of the present invention will now be described in specific detail with reference to FIGS. 1–3. In FIGS. 1 and 3, reference numeral 2 denotes a vehicle; 4 an internal combustion engine vertically disposed in the vehicle body 2, which engine 4 is mounted such that the crankshaft of the engine 4 is oriented generally along the longitudinal vehicle axis; 6 a cylinder head; and, 8 a cylinder head cover.

As shown in FIG. 3, the engine 4 is provided with an intake manifold 10 and an exhaust manifold 12. The intake manifold 10 is equipped integrally with a surge tank 14 on the upstream side thereof. The intake manifold 10 is fixed to the cylinder head 6 by means of a stay 16. A throttle body 18 is mounted on the surge tank 14 on the upstream side thereof. The engine 4 is also provided with a cooling fan 20, a first auxiliary machine 22, a second auxiliary machine 24, a delivery pipe 28 with a pressure regulator 26, a blow-by gas pipe 30 for fresh air, a blow-by gas pipe 32 for gas, a crank angle sensor 34, and a cooled water pipe 36. The first and second auxiliary machines 22 and 24 are driven by a belt 38. In FIG. 3, reference numeral 64 denotes an exhaust manifold cover.

Figure 2:
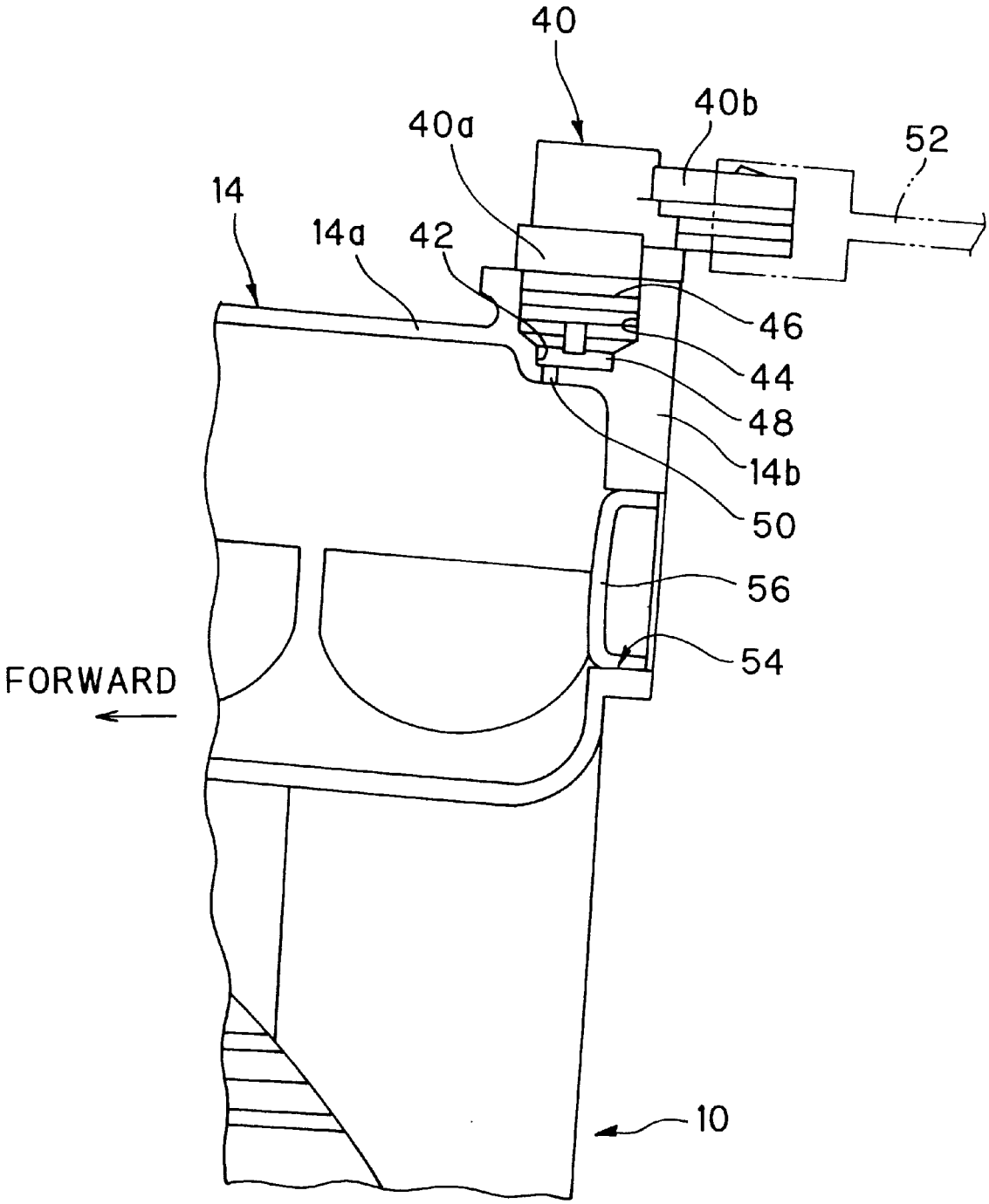
FIG. 2 is an enlarged illustration showing an essential portion of FIG. 1.
Figure 3:
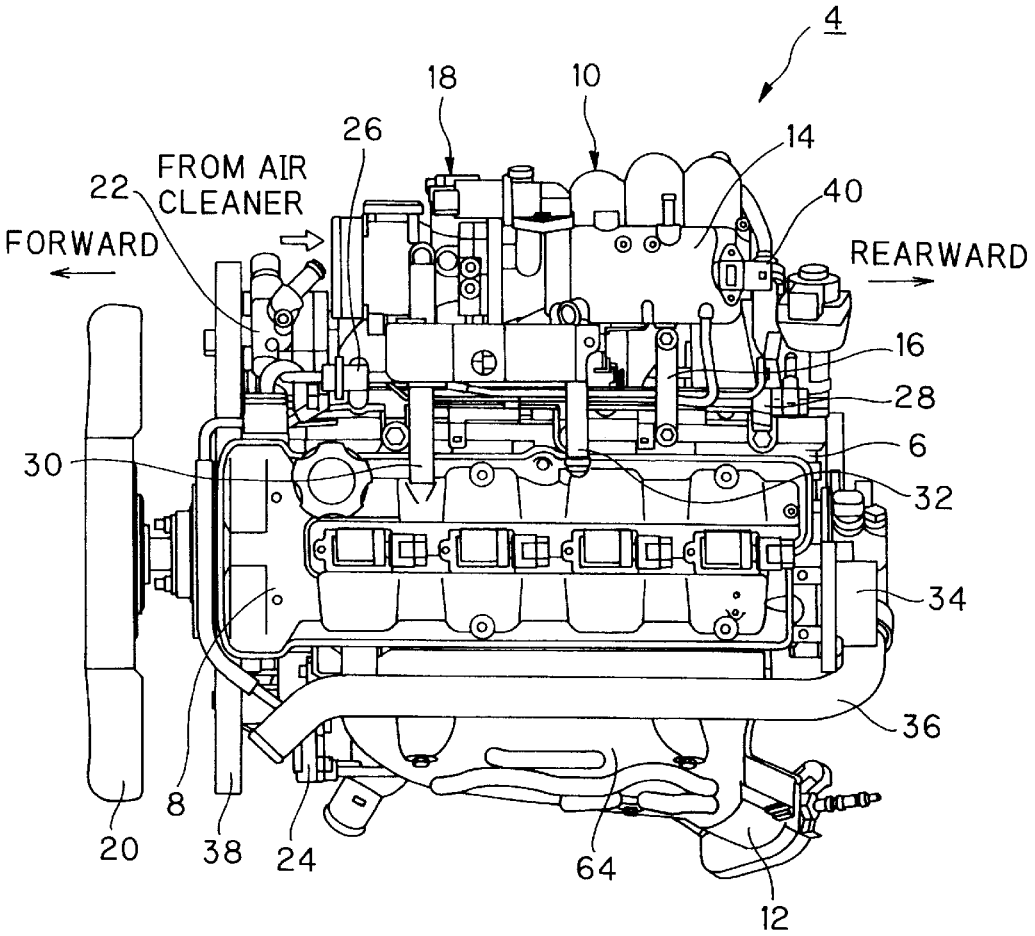
FIG. 3 is a top view of the engine.
Figure 4:
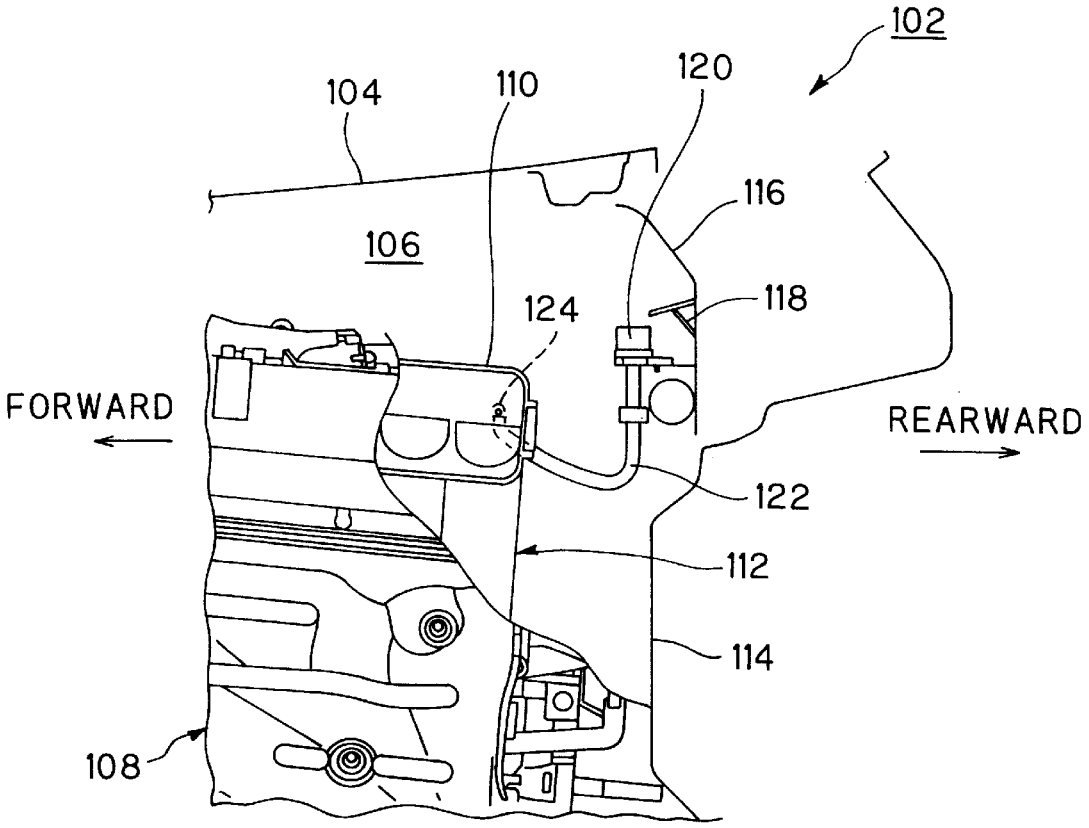
FIG. 4 PRIOR ART
FIG. 4 is a fragmentary side view of an engine and illustrating a conventional pressure-detecting device.

As illustrated in FIGS. 1 and 2, a main body 40*a* of a pressure sensor 40 is disposed on the top 14*a* of the surge tank 14 for detecting intake pipe pressure. More specifically, a sensor-mounting hole 44 is formed in a rear end portion 14*b* of the top 14*a* at the rear of the intake manifold 10. The hole 44 includes a staged or stepped portion 42. The main body 40*a* of pressure sensor 40 is mounted in the sensor-mounting hole 44 and is sealed therein by sealing material 46. In addition, a detection chamber 48 is defined in the sensor-mounting hole 44 between a bottom surface of the hole 44, a distal end portion of the main body 40*a*, and the staged portion 42 in order to permit the pressure sensor 40 to sense the intake pipe pressure. The detection chamber 48 is connected to and communicates with the inside of the surge tank 14 through a communication hole So. The hole 50 extends through the top 14*a* of the surge tank 14 between chamber 48 and the inside of surge tank 14.

The pressure sensor 40 is connected to a harness 52 at a connector section 40*b* thereof.

In addition, the surge tank 14 has a core sand removing hole 54 formed in the rear end portion 14*b* thereof, with a pipe plug 56 mounted therein for closing the hole 54.

As illustrated in FIG. 1, a vertical type of the engine 4 is lower in height at the rear thereof, as opposed to a bonnet hood defining a space thereunder. The following are arranged behind the engine 4: a dash panel 58; a vehicle-side panel 60; and, a wire harness 62. In FIG. 1, reference numeral 66 denotes a hood outline; 68 an engine room; and, 70 a hood inner.

Since the main body 40*a* of the pressure sensor 40 is mounted directly on the top 14*a* of the surge tank 14, then conventional components such as a bracket, a pressure introduction hose, a clip, and a pipe need not be provided. As a result, there is no possibility of such piping or the equivalent becoming clogged with foreign matter or due to freezing of liquid within the piping. Consequently, the sensor 40 can obtain a detected value with improved reliability.

In addition, since the pressure sensor 40 is mounted on the surge tank 14, it is possible to install the pressure sensor 40 at virtually any position on the top 14*a* of the surge tank 14. This feature increases the degree of freedom in mounting the pressure sensor 40. As a result, the pressure sensor 40 can be positioned at the optimum position for detecting intake pipe pressure.

Further, since the pressure sensor 40 is arranged at the rear end portion 14*b* of the surge tank 14 in the vertical type of the engine 4 (or vertically mounted engine 4), then the sensor 40 is located closer to the dash panel 58, and thus the wire harness 62, thereby facilitating the cable routing of the harness 52. In addition, since a hood panel (not shown) is slanted in the forward direction of the vehicle because of the layout of the vehicle, the clearance between the rear part of the hood panel and the pressure sensor 40 can easily be ensured. Still further, since the piping and the like is unnecessary, then it is possible to provide a pressure sensor having a simplified structure with fewer components, and further to provide improved assembility of the pressure sensor 40.

As evidenced by the above-detailed description, pursuant to the present invention, the pressure sensor is disposed directly on the top of the surge tank without the need for piping and the like. This feature eliminates the clogging of such piping or an equivalent thereof with foreign matter or due to freezing. In addition, the pressure sensor is mounted at a selectable position, and can thus detect intake pipe pressure properly.

Although a particular preferred embodiment of the invention has been disclosed in detail for illustrative purposes, it will be recognized that variations or modifications of the disclosed apparatus, including the rearrangement of parts, lie within the scope of the present invention.

What is claimed is:

1. A combination intake manifold and pressure sensor for an internal combustion engine provided in a vehicle having a dash panel disposed rearwardly of the engine and an engine covering hood which has a rear section positioned adjacent the dash panel, the hood angling downwardly as same projects forwardly from the rear section thereof, said combination comprising:

an intake manifold having a surge tank disposed at an upper portion thereof;

a pressure sensor for detecting intake pipe pressure inside said intake manifold; and said surge tank having a top part disposed adjacent the hood of the vehicle, said surge tank being disposed such that said top part thereof angles downwardly as same projects rearwardly toward the dash panel, said top part terminating in a rear portion disposed adjacent the dash panel and spaced downwardly from the rear section of hood, said pressure sensor being mounted on said rear portion generally between said rear portion and the rear section of the hood.

2. The combination of claim 1 wherein said pressure sensor comprises a main body portion and said top part defines a mounting hole therein, said main body portion of said pressure sensor being sealingly disposed within said mounting hole.

3. The combination of claim 1 wherein said main body portion of said pressure sensor has a bottom surface and said mounting hole is defined by a bottom wall and a side wall of said top part which extends transversely with respect to said bottom wall, said main body portion is disposed within said mounting hole such that said bottom surface thereof is spaced from said bottom wall to define a pressure detection chamber therebetween, said top part of said surge tank including a passage extending between said pressure detection chamber and an interior of said surge tank.

4. The combination of claim 1 wherein the engine is vertically mounted in the vehicle and said surge tank is disposed at a rear upper portion of said intake manifold.

5. An intake manifold assembly for an internal combustion engine provided in a vehicle having a dash panel disposed rearwardly of the engine, the engine being mounted in the vehicle such that a crankshaft of the engine is oriented generally along a longitudinal axis of the vehicle, and the rear of the engine adjacent the dash panel is spaced a larger vertical distance from a vehicle hood than the front of the engine, said assembly comprising:

an intake manifold having a surge tank disposed at a rear upper portion thereof adjacent the rear of the engine such that said surge tank angles downwardly as same projects rearwardly toward the dash panel; and a pressure sensor for detecting intake pipe pressure inside said intake manifold, said pressure sensor being mounted on a rear top portion of said surge tank adjacent the dash panel in a space defined generally vertically between said rear top portion of said surge tank and the vehicle hood.

6. The assembly of claim 5 wherein said rear top portion of said surge tank defines therein a mounting hole which receives said pressure sensor therein, said pressure sensor being mounted in said mounting hole such that a lower surface of said pressure sensor is spaced from a lower terminal end of said mounting hole to define a pressure detection chamber which forms part of said mounting hole, said pressure detection chamber communicating with an interior of said surge tank.

7. The assembly of claim 6 wherein said mounting hole has a stepped configuration which divides said mounting hole into a first hole portion disposed adjacent an upper surface of said rear top portion and a second hole portion spaced downwardly from said upper surface, said pressure sensor being disposed in said first hole portion and said pressure detection chamber being defined by said second hole portion.

8. The assembly of claim 5 wherein the vehicle hood has a rear section adjacent the dash panel and the vehicle hood angles downwardly as same projects forwardly from the rear section thereof, said pressure sensor being mounted in a dead engine space defined generally vertically between the rear section of the hood and said rear top portion of said surge tank.

* * * * *

UNITED STATES PATENT AND TRADEMARK OFFICE

CERTIFICATE OF CORRECTION

PATENT NO. : 6,016,781
DATED : January 25, 2000
INVENTOR(S) : Takeshi Toyama

It is certified that error appears in the above-identified patent and that said Letters Patent is hereby corrected as shown below:

Column 4,
Line 11; change "claim 1" to -- claim 2 --.

Signed and Sealed this

Twenty-first Day of August, 2001

*Attest:*

Nicholas P. Godici

NICHOLAS P. GODICI
*Acting Director of the United States Patent and Trademark Office*

*Attesting Officer*